US010254690B2

(12) United States Patent
Takagi

(10) Patent No.: US 10,254,690 B2
(45) Date of Patent: Apr. 9, 2019

(54) HEATER AND FIXING DEVICE

(71) Applicants: TOSHIBA TEC KABUSHIKI KAISHA, Tokyo (JP); TOSHIBA HOKUTO ELECTRONICS CORPORATION, Hokkaido (JP)

(72) Inventor: Osamu Takagi, Chofu Tokyo (JP)

(73) Assignees: TOSHIBA TEC KABUSHIKI KAISHA, Tokyo (JP); TOSHIBA HOKUTO ELECTRONICS CORPORATION, Hokkaido (JP)

( * ) Notice: Subject to any disclaimer, the term of this patent is extended or adjusted under 35 U.S.C. 154(b) by 0 days.

(21) Appl. No.: 15/621,583

(22) Filed: Jun. 13, 2017

(65) Prior Publication Data

US 2017/0364003 A1 Dec. 21, 2017

(30) Foreign Application Priority Data

Jun. 20, 2016 (JP) ..... 2016-121441
May 16, 2017 (JP) ..... 2017-097235

(51) Int. Cl.
*G03G 15/20* (2006.01)

(52) U.S. Cl.
CPC ..... *G03G 15/2053* (2013.01); *G03G 15/2057* (2013.01); *G03G 15/2042* (2013.01); *G03G 2215/2025* (2013.01)

(58) Field of Classification Search
CPC ..... G03G 15/2014; G03G 15/2017; G03G 15/2039; G03G 15/2042; G03G 15/205; G03G 15/2053; G03G 15/2078; G03G 15/2082
USPC ..... 399/320, 328, 334
See application file for complete search history.

(56) References Cited

U.S. PATENT DOCUMENTS

| | | | | |
|---|---|---|---|---|
| 5,171,969 | A | 12/1992 | Nishimura et al. | |
| 5,367,320 | A | 11/1994 | Taniguchi et al. | |
| 6,084,208 | A | 7/2000 | Okuda et al. | |
| 9,261,832 | B2 | 2/2016 | Muramatsu et al. | |
| 2011/0044736 | A1* | 2/2011 | Konishi | H01K 1/06 219/538 |
| 2015/0037052 | A1 | 2/2015 | Muramatsu et al. | |
| 2015/0331372 | A1 | 11/2015 | Takagi | |

FOREIGN PATENT DOCUMENTS

| | | | |
|---|---|---|---|
| EP | 0497551 | 8/1992 | |
| JP | H02-116559 | 5/1990 | |
| JP | H04-259785 | 9/1992 | |
| JP | 2629980 | 7/1997 | |
| JP | 2015-028531 | 2/2015 | |
| JP | 2015169678 A * | 9/2015 | G03G 15/20 |

OTHER PUBLICATIONS

Extended European Search Report dated Nov. 6, 2017, filed in counterpart European Patent Application No. 17176300.6 (10 pages).

* cited by examiner

*Primary Examiner* — Benjamin R Schmitt
(74) *Attorney, Agent, or Firm* — Kim & Stewart LLP

(57) ABSTRACT

There is provided a heater according to an embodiment including a heat generating unit configured to generate heat by electric conduct ion; and a plurality of electrodes configured to be respectively disposed at facing side edges of the heat generating unit so as to be electrically connected to the heat generating unit and at least one side of the side edges is formed by cutting out a part thereof.

10 Claims, 10 Drawing Sheets

HEATER AND FIXING DEVICE

CROSS-REFERENCE TO RELATED APPLICATION

This application is based upon and claims the benefit of priority from the prior Japanese Patent Application No. 2016-121441, filed on Jun. 20, 2016, and Japanese Patent Application No. 2017-97235, filed on May 16, 2017, the entire contents of all which are incorporated herein by reference.

FIELD

Embodiments described herein relate generally to a heater and a fixing device.

BACKGROUND

In recent years, in a fixing device using a resistance heat generating element, it is studied to dispose a heat generating unit, in which a heat generating region is divided into a plurality of portions, in a main scanning direction and selectively generate heat in the heat generating region corresponding to a sheet size (JP-A-2015-028531). However, if the heat generating region of the resistance heat generating element is divided, there is a problem that a temperature decreases at a connection portion between adjacent regions.

In a fixing device for electrophotography, if heat generation unevenness occurs in a direction perpendicular to a sheet transporting direction, the fixing quality is affected. In particular, for color printing, a difference in coloring and gloss may occur.

In general, according to one embodiment, there is provided a heater and a fixing device capable of preventing a temperature decrease in a connection portion between adjacent regions if a heat generating region of a resistance heat generating element is divided.

DETAILED DESCRIPTION

A heater according to an embodiment includes a heat generating unit configured to generate heat by electric conduction; and a plurality of electrodes configured to be respectively disposed at facing side edges of the heat generating unit so as to be electrically connected to the heat generating unit and at least one side of the side edges is formed by cutting out a part thereof.

Figure 7:
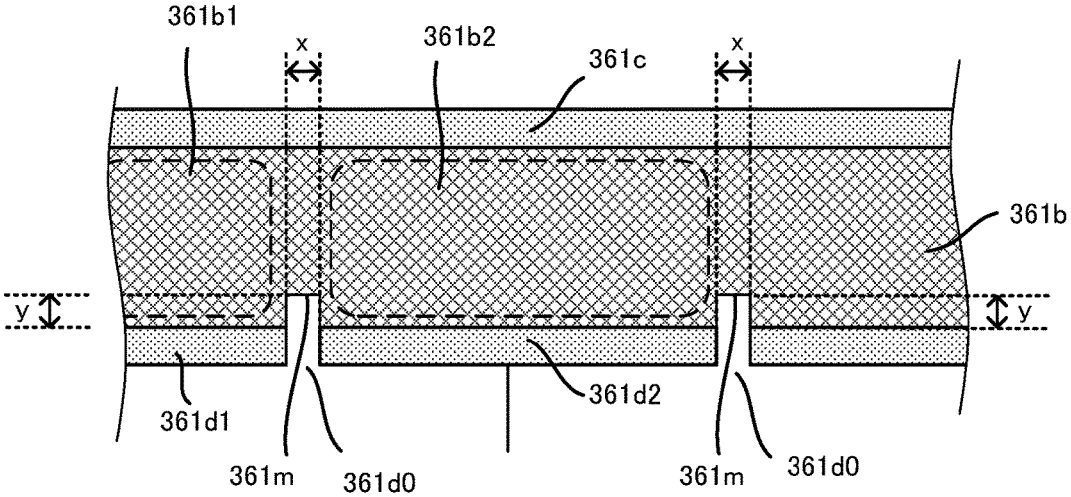
FIG. 7 is an enlarged view of a broken line area of FIG. 6.

For example, as illustrated in FIG. 7, the embodiment is directed to a heater or the like which suppresses a temperature decrease in a region present between heat generating regions generated by electric conduction between a plurality of individual electrodes 361*d*1, 361*d*2, and the like, and a common electrode 361*c* respectively provided at the side edges of a rectangular heat generating unit 361.

(Configuration Example of Image Forming Apparatus)

Figure 1:
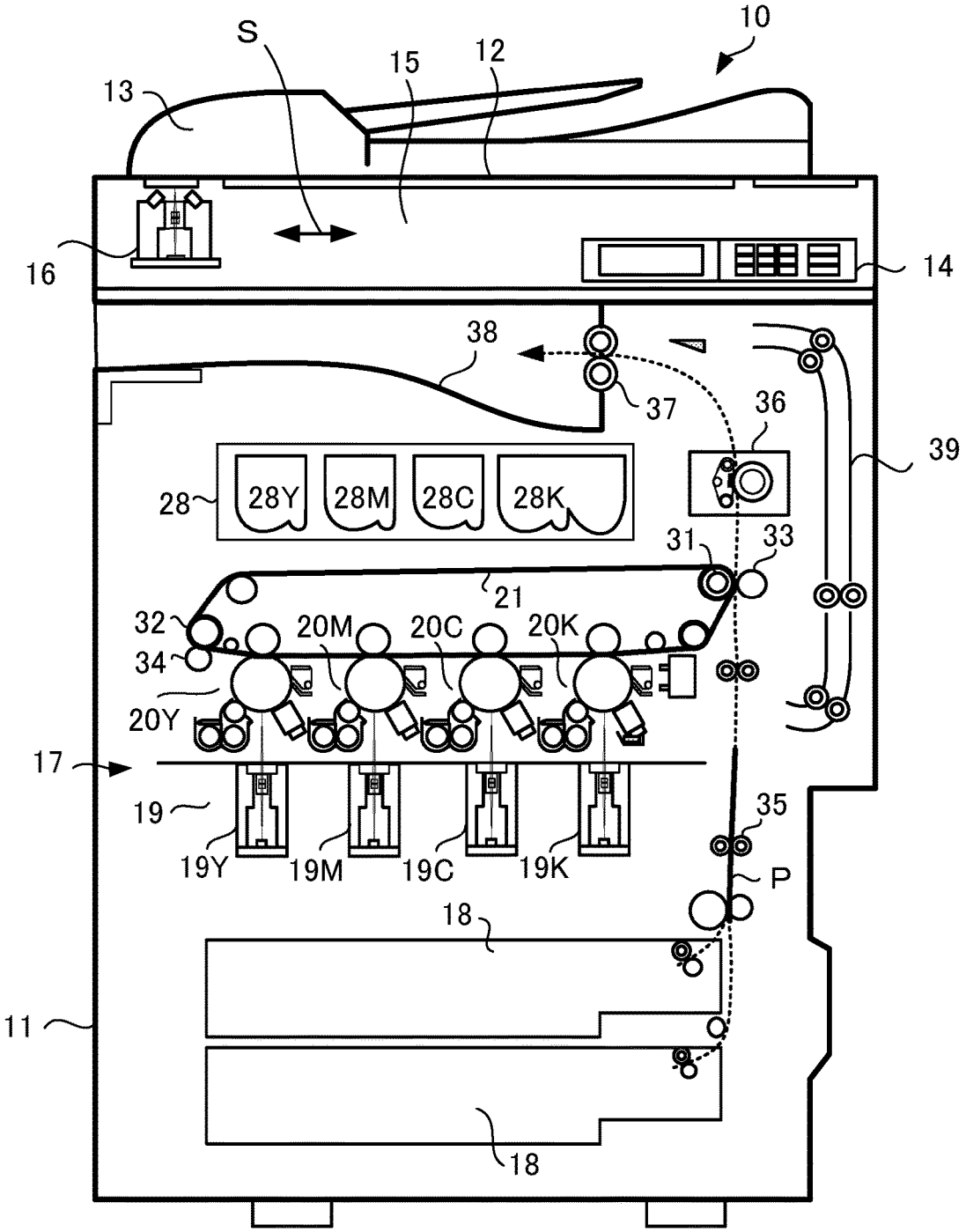
FIG. 1 is a view illustrating a configuration example of an image forming apparatus using a fixing device according to an embodiment.

FIG. 1 is a view illustrating a configuration example of an image forming apparatus using a fixing device according to a first embodiment. In FIG. 1, the image forming apparatus is, for example, a Multi-Function Peripherals (MFP) which is a multifunction machine, a printer, a copying machine, or the like. In the following description, an MFP 10 will be described as an example.

A transparent glass original document platen 12 is provided on an upper portion of a body 11 of the MFP 10 and an automatic original document transporting unit (ADF) 13 is disposed on the original document platen 12 so as to be freely opened and closed. In addition, an operation panel 14 is disposed on the upper portion of the body 11. The operation panel 14 has various kinds of keys and a touch panel type display unit.

A scanner unit 15 that is a reading device is disposed under the ADF 13 within the body 11. The scanner unit 15 reads an original document transmitted by the ADF 13 or an original document placed on the original document platen to generate image data and includes a close contact type image sensor 16. The image sensor 16 is disposed in a direction in which main scanning is performed with respect to the original document, that is, in a main scanning direction, or in a depth direction in FIG. 1, and moves in an arrow S direction to perform sub-scanning.

When reading an image of the original document placed on the original document platen 12, the image sensor 16 reads the image of the original document one line by one while moving along the original document platen 12. The operation is executed over an entire original document size to read the original document of one page. In addition, when reading the image of the original document transmitted by the ADF 13, the image sensor 16 is at a fixed position (position illustrated in the drawing).

Furthermore, a printer unit 17 is disposed at a center portion within the body 11 and a plurality of sheet feed cassettes 18 for accommodating sheets P of various sizes are disposed in a lowest portion of the body 11. The printer unit 17 has a photoconductive drum and a scanning head 19 including a LED as an exposure device, and scans the photoconductive drum with light from the scanning head 19 to generate an image.

The printer unit 17 processes image data read by the scanner unit 15, or image data created by a personal computer or the like to form an image on a sheet. The printer unit 17 is, for example, a tandem-type color laser printer and includes image forming units 20Y, 20M, 20C, and 20K of each color of yellow (Y), magenta (M), cyan (C), and black (K). The image forming units 20Y, 20M, 20C, and 20K are disposed in parallel below an intermediate transfer belt 21 from an upstream side to a downstream side. In addition, the scanning head 19 also has a plurality of scanning heads 19Y, 19M, 19C, and 19K corresponding to the image forming units 20Y, 20M, 20C, and 20K.

Figure 2:
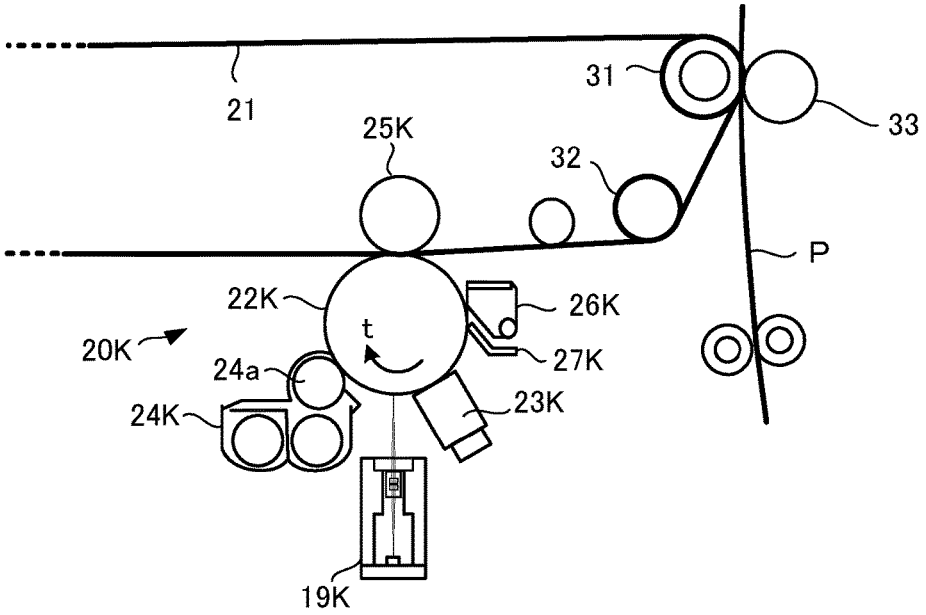
FIG. 2 is an enlarged view of a configuration of a part of an image forming unit in an embodiment.

FIG. 2 is an enlarged view of a configuration of the image forming unit 20K of the image forming units 20Y, 20M, 20C, and 20K. In addition, in the following description, since the image forming units 20Y, 20M, 20C, and 20K respectively have the same configuration, the image forming unit 20K will be described as an example.

The image forming unit 20K has a photoconductive drum 22K that is an image carrier. A charging device 23K, a developing device 24K, a primary transfer roller (transfer device) 25K, a cleaner 26K, a blade 27K, and the like are disposed around the photoconductive drum 22K along a rotating direction t. An exposure position of the photoconductive drum 22K is irradiated with light from the scanning head 19K to form an electrostatic latent image on the photoconductive drum 22K.

The charging device 23K of the image forming unit 20K uniformly charges a surface of the photoconductive drum 22K. The developing device 24K supplies a two-component developer containing black toner and carrier to the photoconductive drum 22K using a developing roller 24*a* to which a developing bias is applied and performs developing of the electrostatic latent image. The cleaner 26K removes residual toner on the surface of the photoconductive drum 22K using the blade 27K.

In addition, as illustrated in FIG. 1, a toner cartridge 28 for supplying toner to the developing devices 24Y, 24M, 24C, and 24K is provided above the image forming units 20Y, 20M, 20C, and 20K. The toner cartridge 28 includes toner cartridges 28Y, 28M, 28C, and 28K of each color of yellow (Y), magenta (M), cyan (C), and black (K).

The intermediate transfer belt 21 moves cyclically. The intermediate transfer belt 21 is stretched around a driving roller 31 and a driven roller 32. In addition, the intermediate transfer belt 21 the intermediate transfer belt 21 faces and is in contact with the photoconductive drums 22Y, 22M, 22C, and 22K. A primary transfer voltage is applied to a position of the intermediate transfer belt 21 facing the photoconductive drum 22K by the primary transfer roller 25K and the toner image on the photoconductive drum 22K is primarily transferred to the intermediate transfer belt 21.

A secondary transfer roller 33 is disposed to face the driving roller 31 around which the intermediate transfer belt 21 is stretched. When the sheet P passes between the driving roller 31 and the secondary transfer roller 33, a secondary transfer voltage is applied to the sheet P by the secondary transfer roller 33. Therefore, the toner image on the intermediate transfer belt 21 is secondarily transferred onto the sheet P. A belt cleaner 34 is provided in the vicinity of the driven roller 32 of the intermediate transfer belt 21.

In addition, as illustrated in FIG. 1, a sheet feed roller 35 which transports the sheet P taken out from the inside of the sheet feed cassette 18 is provided between the sheet feed cassette 18 and the secondary transfer roller 33. Furthermore, a fixing device 36 is provided on a downstream side of the secondary transfer roller 33. In addition, a transport roller 37 is provided on a downstream side of the fixing device 36. The transport roller 37 discharges the sheet P to a sheet discharge unit 38. Furthermore, a reverse transporting path 39 is provided on a downstream side of the fixing device 36. The reverse transporting path 39 is used for reversing the sheet P, leads the sheet P in a direction of the secondary transfer roller 33, and is used for double-sided printing. FIGS. 1 and 2 illustrate an example of the embodiment and a structure of the image forming apparatus portion other than the fixing device 36 is not limited, and it is possible to use a structure of a known electrophotographic image forming apparatus.

(Configuration Example of Control System of MFP 10)

Figure 3:
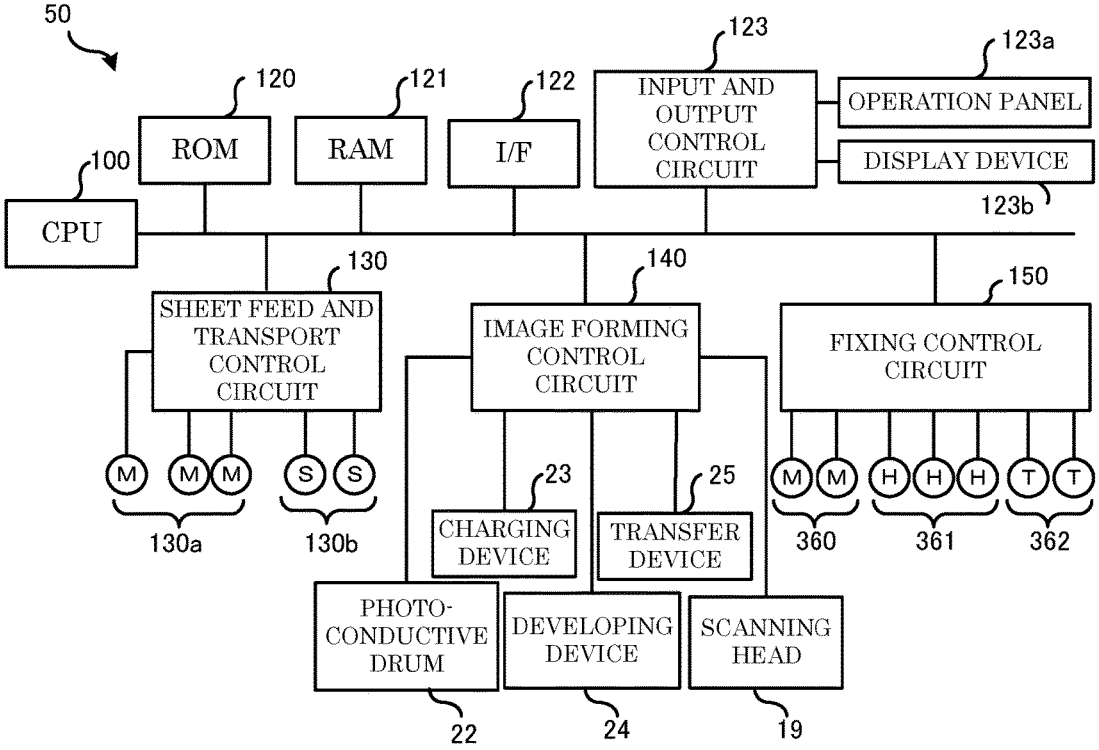
FIG. 3 is a block diagram illustrating a configuration example of a control system of an MFP in an embodiment.

FIG. 3 is a block diagram illustrating a configuration example of a control system 50 of the MFP 10 in an embodiment. The control system 50 includes, for example, a CPU 100 which controls an entirety of the MFP 10, a read only memory (ROM) 120, a (random access memory (RAM) 121, an interface (I/F) 122, an input and output control circuit 123, a sheet feed and transport control circuit 130, an image forming control circuit 140, and a fixing control circuit 150.

The CPU 100 realizes a processing function for forming an image by executing a program stored in the ROM 120 or the RAM 121. The ROM 120 stores a control program and control data that govern basic operations of an image forming process. The RAM 121 is a working memory. The ROM 120 (or the RAM 121) stores a control program of the image forming unit 20, the fixing device 36, or the like, and various kinds of control data used by the control program. As an specific example of the control data in the embodiment, a corresponding relationship between sizes of a printing region in a sheet, that is, widths (first, second, and third medium sizes in FIG. 5 described below) in the main scanning direction in which the original document is main-scanned, and a heat generating unit that is a power supplying target, or the like is exemplified.

A fixing temperature control program of the fixing device 36 includes a determination logic for determining the size of an image forming region in a sheet on which the toner image is formed, and a heating control logic for selecting a switching element of the heat generating unit corresponding to a position through which the image forming region passes before the sheet is transported on the inside of the fixing device 36 to supply power, and controlling heating in a heating unit.

The I/F 122 communicates with various devices such as a user terminal and a facsimile. The input and output control circuit 123 controls an operation panel 123*a* and a display device 123*b*. The sheet feed and transport control circuit 130 controls a motor group 130*a* or the like for driving the sheet feed roller 35, the transport roller 37 of the transporting path, or the like. The sheet feed and transport control circuit 130 controls the motor group 130*a* or the like in consideration of detection results of various sensors 130*b* in the vicinity of the sheet feed cassette 18 or on the transporting path based on a control signal from the CPU 100.

The image forming control circuit 140 controls the photoconductive drum 22, the charging device 23, the scanning head 19, the developing device 24, and the transfer device 25 respectively based on control signals from the CPU 100. The fixing control circuit 150 controls driving motors 360 of the fixing device 36, the heat generating units 361 (heaters), and temperature detection members 362 such as thermistors respectively based on control signals from the CPU 100. In addition, in the embodiment, a configuration in which the control program and the control data of the fixing device 36 are stored in a storage device of the MFP 10 and are executed by the CPU 100 is provided, but a calculation processing device and a storage device may be separately provided exclusively for the fixing device 36.

(Configuration Example of Fixing Device 36)

Figure 4:
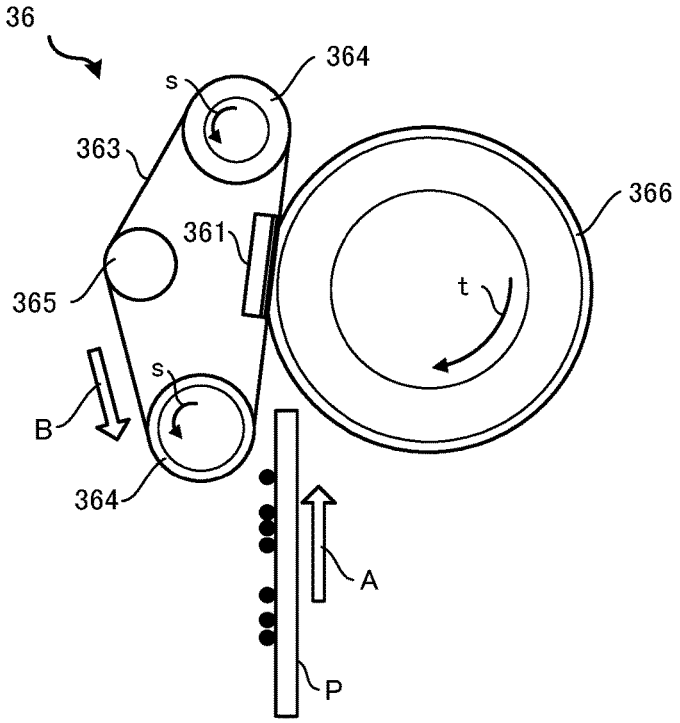
FIG. 4 is a view illustrating a configuration example of a fixing device according to an embodiment.

FIG. 4 is a view illustrating a configuration example of the fixing device 36. Here, the fixing device 36 includes the plate-shaped heat generating unit 361, an endless belt 363 formed with an elastic layer and suspended on a plurality of rollers, a belt transport roller 364 for driving the endless belt 363, a tension roller 365 for applying a tension to the endless belt 363, and a press roller 366 having an elastic layer formed on a surface thereof.

A heat generating unit side of the heat generating unit 361 is in contact with an inside of the endless belt 363 and presses the endless belt 363 in a direction of the press roller 366 thereby forming a fixing nip having a predetermined width between the endless belt 363 and the press roller 366. Since the heat generating unit 361 generates heat while forming a nip region, the responsiveness during supplying power is higher than that of a heating system using a halogen lamp.

In the endless belt 363, a silicone rubber layer having a thickness of 200 μm is formed on an outside of a polyimide which is a SUS base material having a thickness of 50 μm or a heat-resistant resin of 70 μm, and the outermost periphery thereof is covered with a surface protection layer such as PFA. In the press roller 366, for example, a silicon sponge layer having a thickness of 5 mm is formed on a surface of steel bar of ϕ10 mm and the outermost periphery thereof is covered with a surface protection layer such as PFA.

(Configuration of Heat Generating Unit)

In addition, in the heat generating unit 361, for example, a heat generating resistance layer, or a glazed layer and the heat generating resistance layer are laminated on an insulator such as a ceramic substrate. The glazed layer may be omitted. The heat generating resistance layer is formed of, for example, a known material such as $TaSiO_2$. The heat generating resistance layer has a predetermined length in the direction in which the original document is main-scanned in the main scanning direction and is provided in a predetermined number of pieces.

A method of forming the heat generating resistance layer is the same as a known method, for example, a method of making a thermal head. For example, a masking layer (electrode layer) is formed of aluminum on the heat generating resistance layer. The masking layer has such a pattern that the heat generating unit (resistance heat generating element) is exposed in the sheet transporting direction. The pattern separates the heat generating regions.

The power supply to the heat generating unit is connected by a conductor (wiring) from aluminum layers (electrodes) at both ends, and each thereof is connected to a switching element of a switching driver or the like.

Furthermore, a protection layer is formed on the uppermost portion so as to cover all of the resistance heat generating element, the aluminum layer, the wiring, and the like. The protection layer is formed of, for example, $SiO_2$, $Si_3N_4$, or the like. When supplying AC or DC to such a heat generating unit group, power is supplied to a portion generating heat by triac or FET with zero crossing and flicker is also taken into consideration.

Relationship Between Heat Generating Unit and Electrode, and (if Shape of Groove Portion is Rectangular (Concave))

Figure 5:
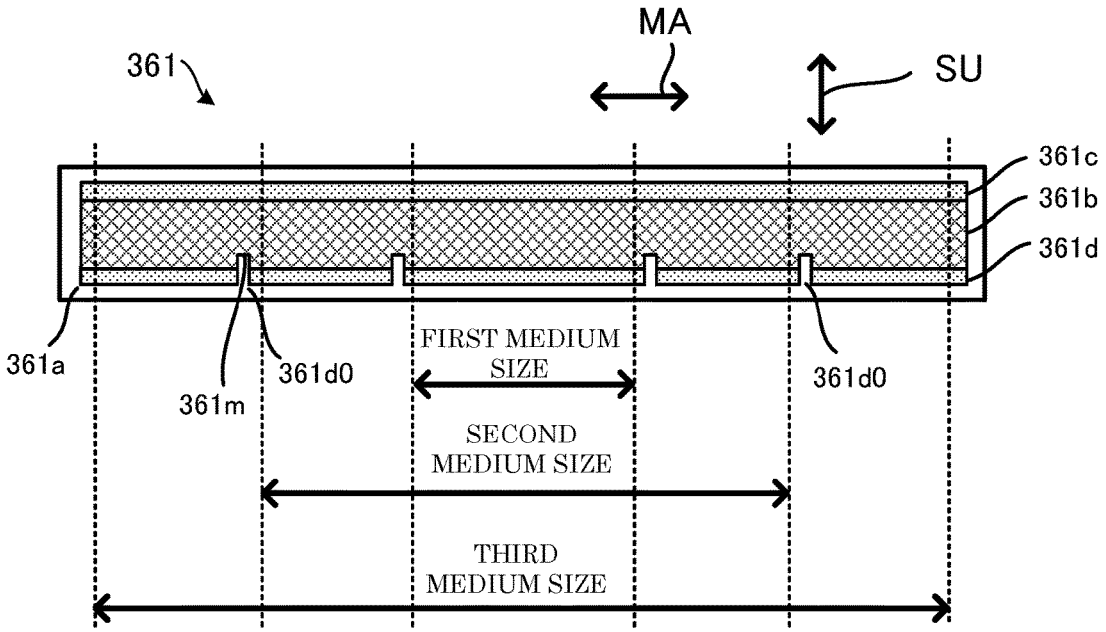
FIG. 5 is a top view illustrating an arrangement of a heat generating unit and an electrode on an insulator substrate in an embodiment.

FIG. 5 is a top view illustrating a relationship between a heat generating unit, a common electrode, and an individual electrode in an embodiment. A heat generating unit 361*b*, a common electrode 361*c*, and an individual electrode 361*d* are provided on an insulator substrate 361*a*.

Here, the electrode on the electrode side at one end is divided into, for example, five by cutout portions which are described below in the main scanning direction (arrow MA) in which the original document is main-scanned and configures an individual electrode 361*d*, and thereby the heat generating region (heat generating unit 361*b*) of the heat generating unit 361 corresponds to widths of postcard size (100×148 mm), CD jacket size (121×121 mm), B5R size (182×257 mm), and A4R size (210×297 mm).

Four groove portions 361*m* are formed at one end (side edge) in a sub-scanning direction (arrow SU direction) of the heat generating unit as rectangular concave portions. The individual electrode 361*d* is formed at a position excluding a plurality of groove portions 361*m* in one end portion of the heat generating unit 361*b* in the transporting direction of the medium. That is, the cutout portions (cutout portions 361*d*0) of the electrode correspond to the groove portions of the heat generating unit.

Figure 6:
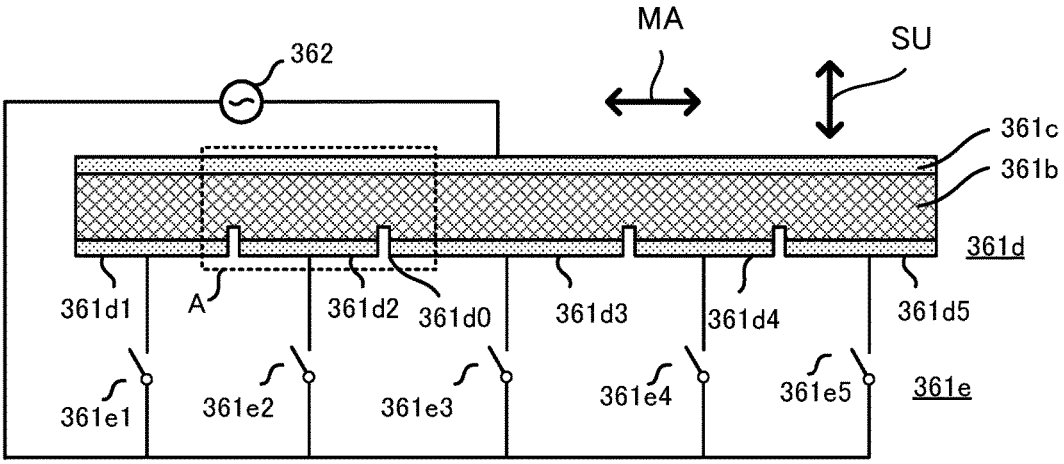
FIG. 6 is a view illustrating a power supplying structure for the heat generating unit of an embodiment illustrated in FIG. 5.

FIG. 6 is a circuit view illustrating a power supplying structure to the heat generating unit 361*b* in an embodiment. Here, in the heat generating region of the heat generating unit 361*b*, a parallel power supplying structure of which electric conduction is controlled by corresponding five switches 361*e* is illustrated.

Specifically, the switch 361*e* is individually formed of 361*e*1, 361*e*2, 361*e*3, 361*e*4, and 361*e*5. The individual electrode 361*d* is formed of 361*d*1, 361*d*2, 361*d*3, 361*d*4, and 361*d*5. As a specific example of a driving IC indicated by the switch 361*e*, a switching element, a FET, a triax, a switching IC, or the like is exemplified.

FIG. 7 is an enlarged view of a broken line area A of FIG. 6. Here, the groove portion 361*m* is formed in which a length (width) in the main scanning direction (arrow MA) of the original document is x and a length (depth) in the sub-scanning direction (arrow SU direction) is y.

An aspect ratio of x and y can be arbitrarily changed and is determined by measuring an in-plane temperature distribution of a connecting portion of the heat generating region. For example, x:y=1:1, or x:y=2:3.

Figure 13:
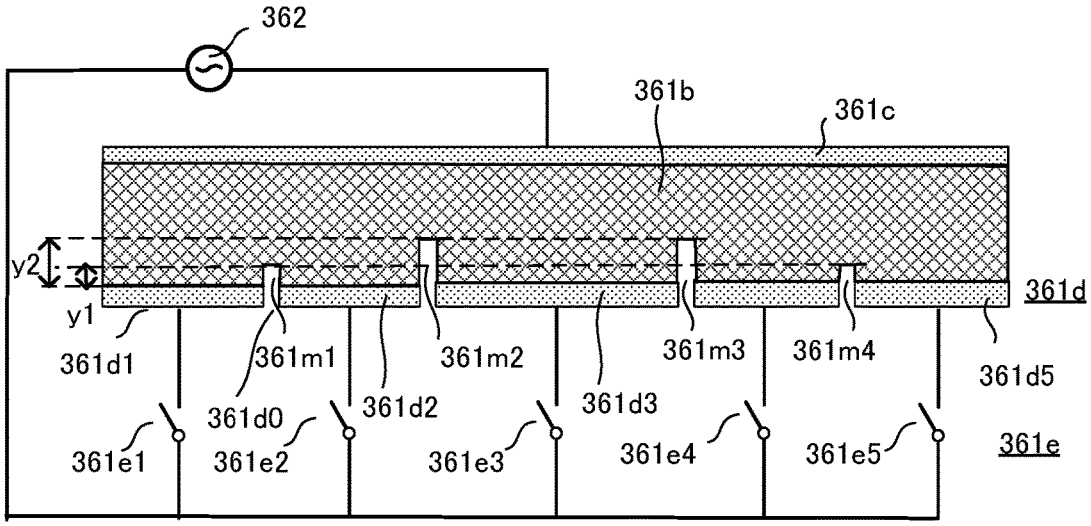
FIG. 13 is a top view of an embodiment in which depths of the groove portions are different from each other.

As described below, values of sizes x and y of the groove portion 361*m* may not be the same and, for example, the value (depth) of y may be changed according to the position of the groove portion 361*m* (see an embodiment of FIG. 13).

In FIG. 6, one end of power supply 362 is connected to the common electrode 361*c* and switches 361*e*1 to 361*e*5 are connected in parallel to the other end of the power supply. The individual electrodes 361*d*1 to 361*d*5 are respectively connected to the switches 361*e*1 to 361*e*5. For example, when the switch 361*e*2 is turned on and a current flows through the heat generating unit 361*b* between the individual electrode 361*d*2 and the common electrode 361 using the power supply 362, the heat generating region 361*b*2 is generated.

Similarly, when a current flows through the heat generating unit 361*b* between the individual electrode 361*d*1 and the common electrode 361*c* using the power supply 362, the heat generating region 361*b*1 is generated.

A portion having a lower temperature than that of the heat generating region is generated between the heat generating region 361*b*2 and the heat generating region 361*b*1. The cutout portion of the electrode and the groove portion 361*m* is present between the individual electrode 361*d*2 and the individual electrode 361*d*1. However, since the heat generating unit is continuous in the low temperature portion between the heat generating regions, the temperature does not decrease as the heat generating unit is cut.

As described above, the temperature decrease is suppressed between the heat generating regions. The mechanism will be inferred.

(Mechanism of Suppressing Temperature Decrease Between Heat Generating Regions)

According to the embodiment, the heat generating region of the heat generating unit 361*b* is divided into a plurality of portions and the heat generating unit is continuous between the adjacent heat generating regions. Therefore, even if power is not supplied to one heat generating region of the adjacent heat generating regions corresponding to the medium size, heat is also generated in the region (connecting region) between the heat generating regions to some extent.

Figure 8:
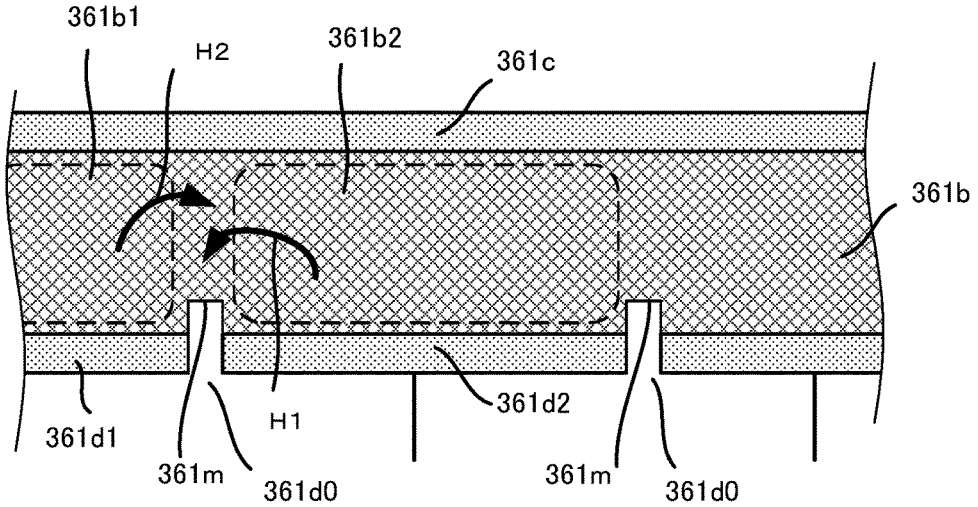
FIG. 8 is an explanatory view for considering a mechanism that is a cause of suppression of reduction of heat between heat generating regions.
Figure 9:
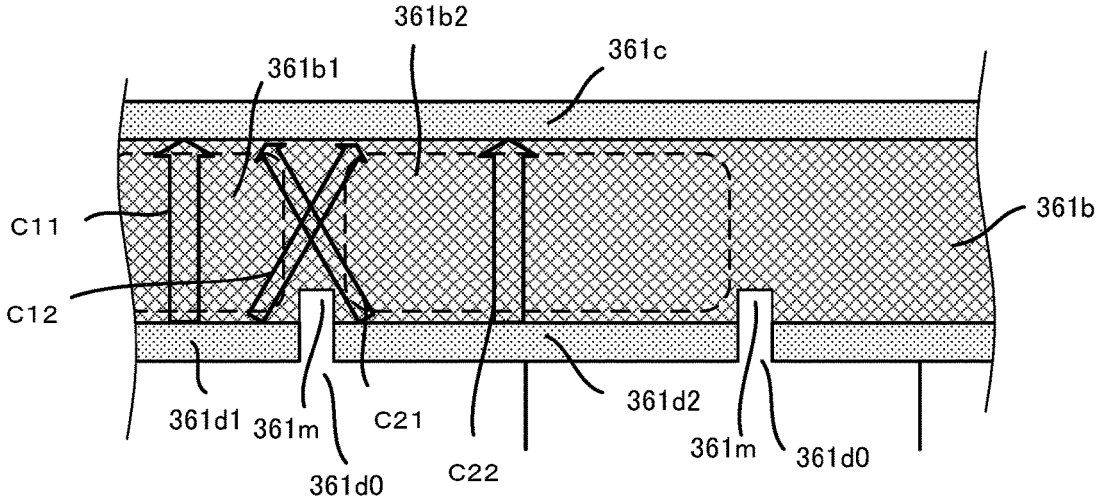
FIG. 9 is another explanatory view for considering a mechanism of a cause of suppression of reduction of heat between the heat generating regions.

The mechanism can be considered two ways. One way is the conduction of heat from the adjacent heat generating regions as illustrated in FIG. 8. The other way is the heat generation by electric conduction between the adjacent individual electrode and the common electrode as illustrated in FIG. 9. Now, in FIG. 7, specifically, suppression of the temperature decrease in the connecting region between the heat generating region 361*b*2 and the heat generating region 361*b*1 is considered.

The heat conduction from the heat generating regions of the former is conceivable as illustrated in FIG. 8. When electric conduction is applied to the heat generating unit 361*b* between the individual electrode 361*d*2 and the common electrode 361*c*, the heat generating region 361*b*2 generates heat and thereby the temperature increases. The heat itself generated by heating of the heat generating region 361*b*2 is considered to be transmitted to the connecting region as indicated by arrow H1. This is because the heat generating unit 361*b* which is a heat conductor is continuous. Similarly, when the heat generating region 361*b*1 generates heat, the heat is considered to be transmitted to the connecting region as indicated by arrow H2.

On the other hand, the heat generation by electric conduction between the adjacent individual electrode and the common electrode is considered as follows. For example, in FIG. 8, the electric conduction is applied to the individual electrode 361*d*1 together with the individual electrode 361*d*2. That is, the electric conduction is applied between the common electrode 361*c* and the individual electrode 361*d*2 via the heat generating unit 361*b*, and the electric conduction is also applied between the common electrode 361*c* and the individual electrode 361*d*1.

In this case, as described above, the heat generating region 361*b*2 is formed by the electric conduction between the common electrode 361*c* and the individual electrode 361*d*2. On the other hand, the heat generating region 361*b*1 is formed by the electric conduction between the common electrode 361*c* and the individual electrode 361*d*1. In this case, a current may flow through the heat generating unit 361*b* not only in arrow C22 direction but also in arrow C21 direction.

On the other hand, the heat generating region 361*b*1 is formed by the electric conduction between the common electrode 351*c* and the individual electrode 361*d*1. In this case, a current may flow through the heat generating unit 361*b* not only in arrow C11 direction but also in arrow C12 direction.

Both the two mechanisms may be functioned. Alternately, the temperature decrease may be suppressed in the region between the heat generating regions by another mechanism. In either case, the temperature decrease between the heat generating regions is suppressed. Regardless of the shape of the groove portion, the same effect can be obtained even if there is no groove portion and only the cutout portion of the electrode is present.

As described above, it is possible to suppress the temperature decrease in the connecting portion compared to a structure in which the heat generating regions are physically separated when the medium size is switched.

(Other Shapes of Groove Portion)

In the embodiment, the case in which the shape of the groove portion 361*m* is rectangular (concave shape) is described. However, the groove portion may be formed in another shape, for example, a U shape or a V shape. In addition, the groove portion 361*m* has a structure that penetrates through the heat generating unit 361 in a vertical direction (direction penetrating a sheet surface in FIG. 5), but the embodiment as the concave portion is not limited to the configuration. For example, a structure in which penetration is performed to an intermediate portion of the heat generating unit 361 in the thickness direction (vertical direction) and the remainder may not be penetrated.

Figure 10:
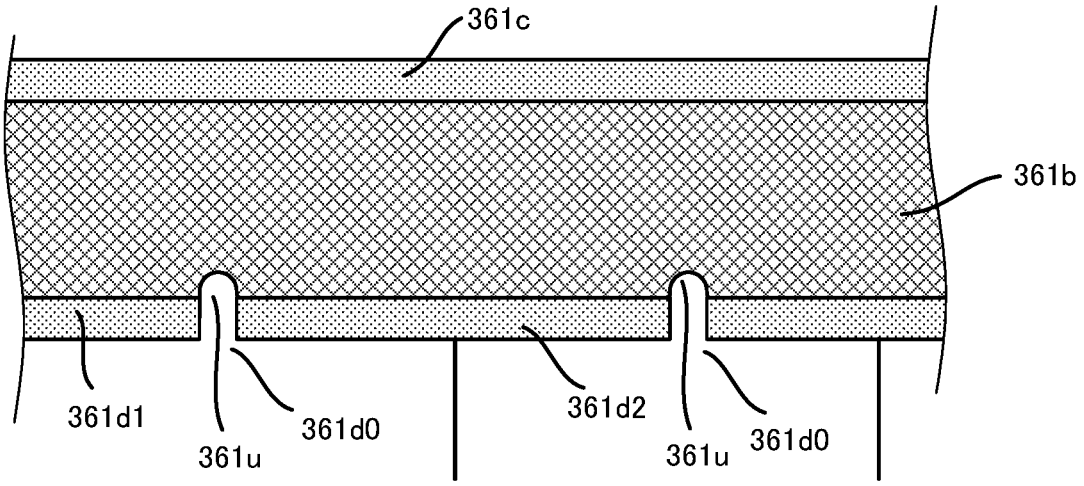
FIG. 10 is a top view of an embodiment in which groove portions of the heat generating unit have a U shape.

FIG. 10 illustrates an enlarged top view of an embodiment in which the shape of the groove portions of the heat generating unit is the U shape. In the embodiment, the common electrode 361*c* is provided on one side of the facing side edges of the rectangular heat generating unit 361*b* generating heat by the electric conduction. The cutout portions of the individual electrodes 361*d*1 and 361*d*2 and groove portions 361*u* of the U shape are provided at corresponding positions on the other side of the side edges.

According to the embodiment in which the groove portion has the U shape, there is no corner in the heat generating unit and a current is unlikely to be locally concentrated compared to the embodiment in which the groove portion has the rectangular shape. Therefore, there is an advantage that a current can f low relatively uniformly through even the vicinity of the groove portion and stable heat generation can be performed.

Figure 11:
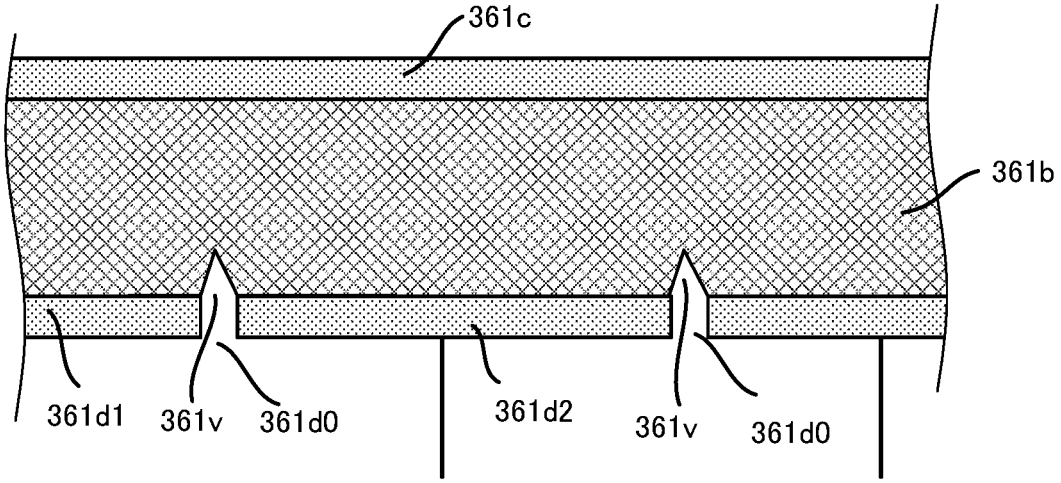
FIG. 11 is a top view of an embodiment in which the groove portions of the heat generating unit have a V shape.

FIG. 11 illustrates an enlarged view of an embodiment in which the groove portions of the heat generating unit have a V shape. In the embodiment, the common electrode 361*c* is provided on one side of the facing side edges of the rectangular heat generating unit 361*b* generating heat by the electric conduction. The cutout portions of the individual electrodes 361*d*1 and 361*d*2 and groove portions 361*v* of the V shape are provided at corresponding positions on the other side of the side edges.

According to the embodiment in which the groove portion has the V shape, the groove portion is gradually enlarged compared to the embodiment in which the groove portion has the rectangular shape. Therefore, since there is little influence of the groove portion on the heat generating unit, there is an advantage that a current can flow relatively uniformly through even in a portion where the groove portion is present and stable heat generation can be performed.

(Embodiment in which there is No Groove Portion in Heat Generating Unit)

Figure 12:
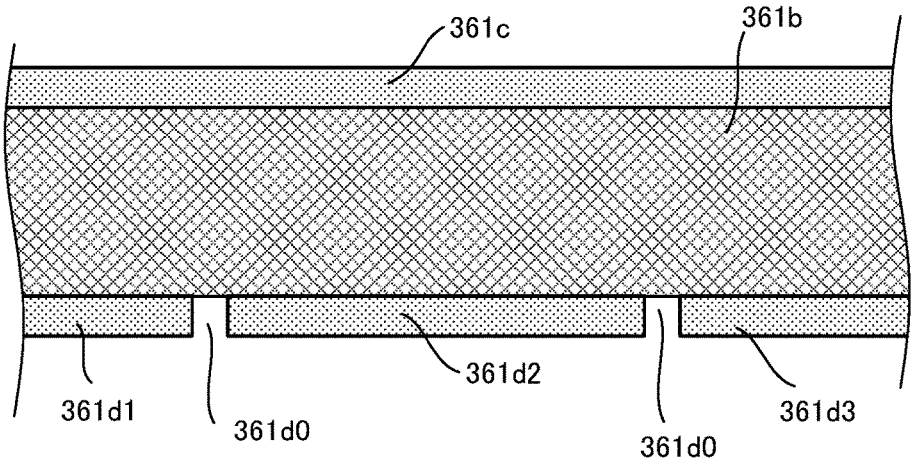
FIG. 12 is a top view of an embodiment in which a groove portion is not provided.

In the above description, the case in which the groove portions are provided corresponding to the cutout portions of the electrode is described. However, if there are the cutout portions of the electrode, a structure without the groove portions may be adopted. FIG. 12 illustrates an enlarged top view of such an embodiment.

In the embodiment, the common electrode 361*c* is provided on one side of the facing side edges of the rectangular heat generating unit 361*b* generating heat by the electric conduction. The individual electrodes 361*d*1, 361*d*2, 361*d*3, and the like are provided on the other side of the side edges. The cutout portion 361*d*0 is provided between the individual electrodes, but there is no groove portion at a position corresponding to the cutout portion 361*d*0.

In the embodiment of the structure, there is the cutout portion of the electrode, but since there is no groove portion in the heat generating unit, there is no constriction and there is an effect that the temperature decrease between the heat generating regions can be minimized.

(Embodiment in which Depth of Groove Portion is Changed)

In the above embodiment, the case in which the shapes of the groove portions, that is, the widths (x) and the depths (y) of the groove portion are same is described.

However, a structure in which the groove portions do not have the same shape and the widths or depths are changed depending on positions where the groove portions are provided may be also provided. FIG. 13 illustrates an embodiment in which depths y of the groove portions are changed.

In the embodiment, the common electrode 361*c* is provided on one side of the facing side edges of the rectangular heat generating unit 361*b* generating heat by the electric conduction. The individual electrodes 361*d*1, 361*d*2, 361*d*3, and the like are provided on the other side of the side edges. Groove port ions corresponding to cutout portions 361*d*0 are provided between the individual electrodes. The groove portions are indicated by 361*m*1, 361*m*2, 361*m*3, and 361*m*4.

The embodiment is the same as that illustrated in FIG. 6 except that the depths of the groove portions are not the same. FIG. 13 is a circuit view illustrating a power supplying structure to the heat generating unit 361*b* in an embodiment. Here, a parallel power supplying structure in which electric conduction of the heat generating regions of the heat generating unit 361*b* is individually controlled by five corresponding switches 361*e* is illustrated.

Specifically, the switch 361*e* is configured of switches 361*e*1, 361*e*2, 361*e*3, 361*e*4, and 361*e*5. The individual electrode 361*d* is configured of 361*d*1, 361*d*2, 361*d*3, 361*d*4, and 361*d*5.

A rectangular groove portion 361*m*1 of a depth y1 is provided corresponding to the cutout portion 361*d*0 between the individual electrode 361*d*1 and the individual electrode 361*d*2. A rectangular groove portion 361*m*2 of a depth y2 is provided corresponding to the cutout portion 361*d*0 between the individual electrode 361*d*2 and the individual electrode 361*d*3. A rectangular groove portion 361*m*3 of the depth y2 is provided corresponding to the cutout portion 361*d*0 between the individual electrode 361*d*3 and the individual electrode 361*d*4. A rectangular groove portion 361*m*4 of the depth y1 is provided corresponding to the cutout portion 361*d*0 between the individual electrode 361*d*4 and the individual electrode 361*d*5.

The shape of the groove portion is not limited to the rectangular shape and may be another shape such as a U shape, or a V shape.

According to the embodiment in which the groove portions having different depths are provided, an effect that imbalance of heat between end portions and the vicinity of a center of the heat generating unit can be adjusted is obtained.

In addition, an embodiment having the groove portion in which not only the depth of the groove portion but also only the width (x) of the groove portion, or both the depth and the width is changed can be provided.

(Embodiment Having Cutout Portion and Groove Portion Also on Common Electrode Side)

In the above embodiment, the common electrode 361*c* is provided on one side edge of the rectangular heat generating unit 361*b*. In the embodiment disclosed here, the common electrode may be changed to the individual electrodes by providing the cutout portions also in the common electrode of the side edge. The number of the cutout portions may be the same as or different from the number of the individual electrodes of the other side edge. In such an embodiment of the embodiment disclosed here, there are embodiments in which the groove portions of the heat generating unit are provided and are not provided.

Figure 14:
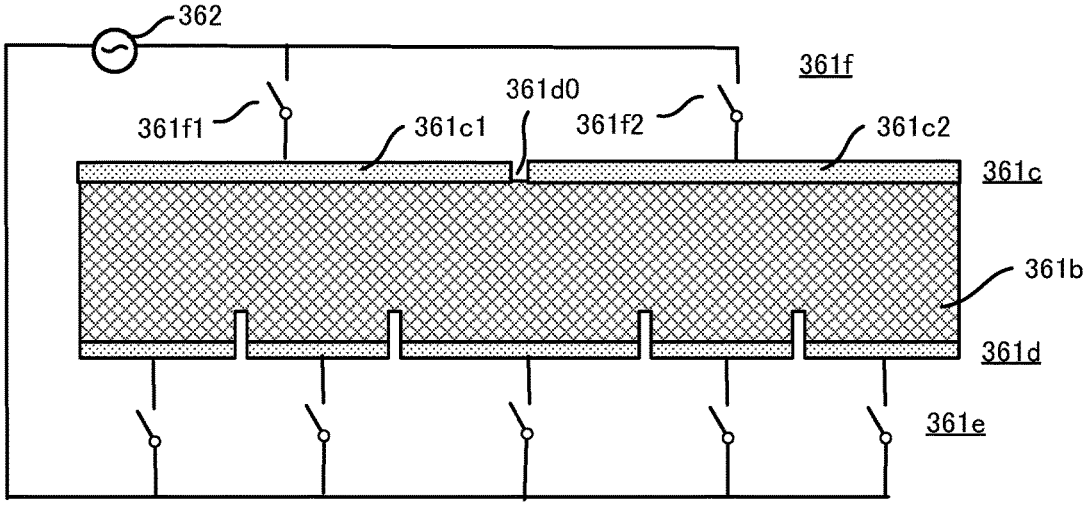
FIG. 14 is a top view of an embodiment in which one cutout portion is disposed on a common electrode side.

FIG. 14 illustrates an embodiment in which the common electrode is divided into two common electrodes 361*c*1 and 361*c*2 by a cutout portion 3611*d*0. In the embodiment, a groove portion is not provided on the common electrode side.

The common electrode 361*c*1 is connected to a switch 361*f*1 and connected to power supply 362. The common electrode 361*c*2 is connected to a switch 361*f*2 and connected to the power supply 362. The common electrodes 361*c*1 and 361*c*2 are collectively referred to the common electrode 361*c*. The switches 361*f*1 and 361*f*2 are collectively referred to the switch 361*f*.

In the embodiment, the common electrode is divided into two and it is possible to change a main heat generating region on the common electrode side by selectively turning on the switches 361*f*1 and 361*f*2.

Figure 15:
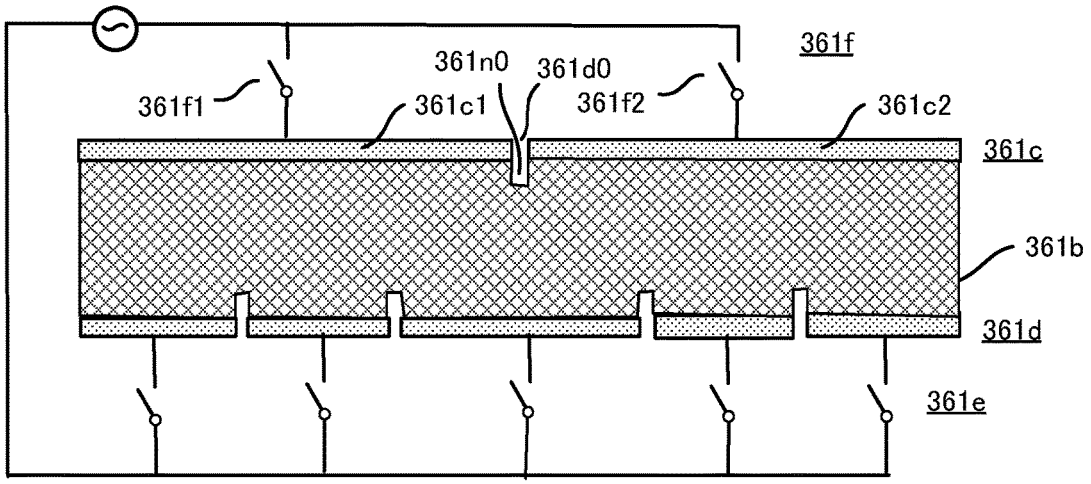
FIG. 15 is a top view of an embodiment in which one cutout portion and one groove portion are disposed on the common electrode side.

FIG. 15 illustrates an embodiment in which the common electrode is divided into two and a cutout portion 361*d*0 and a groove portion 361*n*0 at a position corresponding to the cutout portion are provided.

In the embodiment, the groove portion 361*n*0 is provided at the position corresponding to the cutout portion 361*d*0 between the common electrode 361*c*1 and the common electrode 361*c*2. Except for this point, the embodiment is the same as the embodiment of FIG. 14 and the same reference numerals are given to those of FIG. 14.

Also in the embodiment, the common electrode is divided into two and it is possible to change the heat generating region by selectively turning on the switches 361*f*1 and 361*f*2, and selectively turning on the switches connected to the individual electrodes 361*d* (361*d*1, 361*d*2, 361*d*3, 361*d*4, and 361*d*5).

In the embodiment, since the groove portion 361*n*0 is provided, it is possible to more easily select the heat generating region on the common electrode side than the case of the embodiment of FIG. 14.

Figure 16:
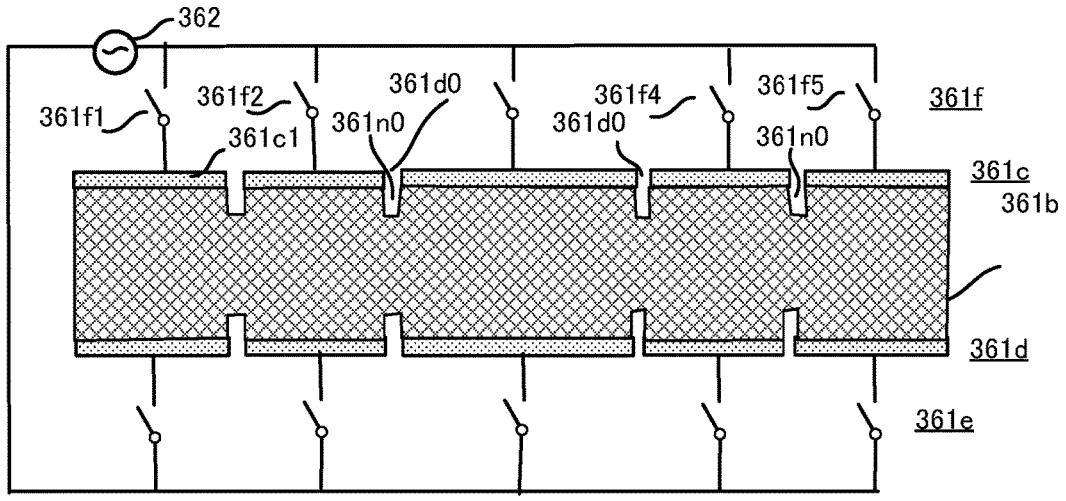
FIG. 16 is a top view of an embodiment in which a plurality of cutout portions and a plurality of groove portions are disposed on the common electrode side.

FIG. 16 illustrates an embodiment in which the individual electrodes having the same number (five in the example) are provided on both side edges and positions at which the groove portions are provided are the same as the positions of the cutout portions. The way assigning reference numerals is the same as that of FIG. 15. It is possible to form the heat generating region in the heat generating unit between the electrode on each individual electrode side and the electrode on the common electrode side by selectively turning on a switch 361*e* and selectively turning on a switch 361*f*.

In the embodiment of FIG. 16, since the positions of the cutout portions and the positions of the corresponding groove portions match, there is an effect that the selection of the heat generating regions is individually made and power consumption can be reduced.

Figure 17:
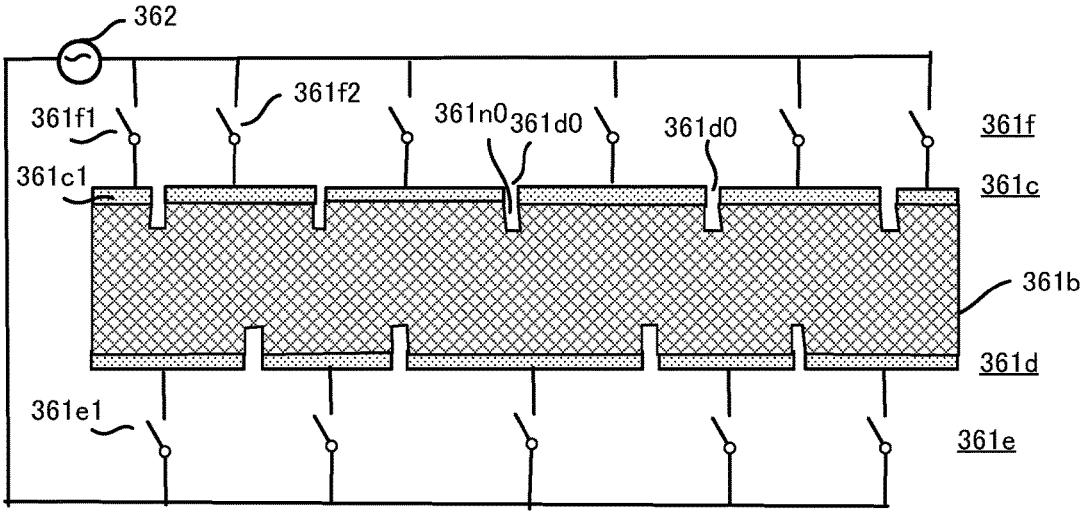
FIG. 17 is a top view of another embodiment in which a plurality of cutout portions and a plurality of groove portions are disposed on the common electrode side.

FIG. 17 illustrates a top view of an embodiment in which the individual electrodes having the same number (five in the example) are provided on both side edges and positions at which the groove portions are provided are different from the positions of the cutout portions. The way assigning reference numerals is the same as that of FIG. 15. It is possible to form the heat generating region in the heat generating unit between the electrode on each individual electrode side and the electrode on the common electrode side by selectively turning on the switch 361*e* and selectively turning on the switch 361*f*.

In the embodiment, since positions of the cutout portions of the electrode and the corresponding groove portions are shifted on the individual electrode side and the common electrode side, there is an effect that the temperature decrease between the heat generating regions can be suppressed.

(Modification Examples of Groove Portion)

Moreover, the number of the heat generating regions and each width in FIG. 5 described above are provided as an example and the embodiments disclosed here are not limited to the configuration. If the MFP 10 corresponds to, for example, five medium sizes, the heat generating region may be divided into five in response to each medium size. That is, the number of the heat generating regions and the divided width can be freely selected depending on the corresponding medium size, and it is possible to uniformly generate heat. Similarly, it is also possible to select the heat generating regions of the power supplying target based on the size of the print size (image forming region) instead of the medium size. In addition, in the example of FIG. 5, an example in which the medium passes through the center region is illustrated, but when the medium passes through a left region or a right region in the main scanning direction (rightward and leftward direction in the drawing), the number, the sizes, and the positions of the heat generating regions may be appropriately changed.

In addition, in the embodiment, a line sensor (not illustrated) is disposed in a sheet passing region and the size and the position of the passing sheet can be determined in real time. The medium size may be determined from image data when starting the printing operation or information of the sheet feed cassette 18 in which the medium (sheet) is stored in the MFP 10.

(Other Embodiments in which Configuration of Fixing Device is Different)

In the configuration example of the fixing device illustrated in FIG. 4 described above, the heat generating unit side of the heat generating unit 361 is in contact with the inside of the endless belt 363 and presses the inside thereof in the direction of the facing press roller 366. Therefore, the toner is heated and fixed to the sheet P which is moved by sandwiched between the endless belt 363 and the press roller 366. In this case, the drive of the endless belt 363 is performed by the belt transport roller 364 connected to the driving motor. However, the sheet P may be transferred by being driven from a press roller side.

Figure 18:
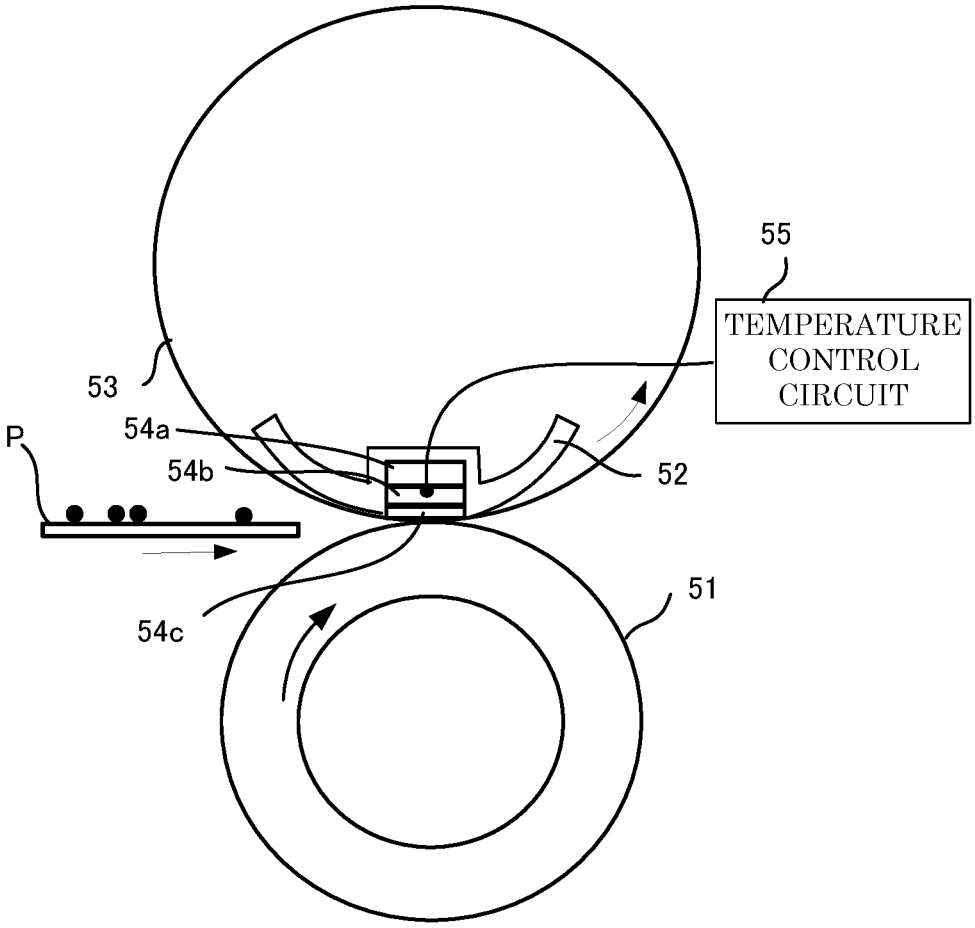
FIG. 18 is a view illustrating a configuration example of a fixing device according to another embodiment.

FIG. 18 illustrates a configuration example of a fixing device of such an example. The fixing device illustrated in FIG. 18 is driven from the press roller side. A film guide 52 having an arcuate cross section is provided so as to face a press roller 51 and a fixing film 53 is rotatably attached to an outside thereof. A ceramic heater 54*a*, a plurality of heat generating units 54*b*, a protection layer 54*c* are laminated on the inside of the film guide 52. The laminated portion is pressed against the press roller via the fixing film to form a nip portion. As described above, the heat generating units are connected in parallel and are connected to a temperature control circuit 55. The temperature control circuit 55 controls opening and closing of a switching element (not illustrated) and controls a temperature thereof.

During the operation of the fixing device, the press roller 51 connected to a driving motor is rotatably driven to follow and rotate the contacting fixing film 53. In this case, the sheet P entering between the fixing film 53 and the press roller 51 from the left side is heated and fixed by the heat generating unit 54*b* and is discharged to the right side.

As described above, the fixing device according to the embodiments disclosed here can also be a fixing device having a structure that applies a driving force from a press roller side.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and their equivalents are intended to cover such forms of modifications as would fall within the scope and spirit of the invention.

What is claimed is:

1. A heater comprising:

a heat generating unit configured to generate heat by electric conduction;

a plurality of electrodes on opposite facing sides of the heat generating unit and electrically connected to the heat generating unit, at least one of the opposite facing sides having at least one groove portion extending partially through the heat generating unit; and a plurality of groove portions extending partially through the heat generating unit, wherein each groove portion respectively corresponds in position along one of the opposite facing sides to a space between an adjacent pair of electrodes in the plurality of electrodes.

2. The heater according to claim 1, wherein a shape of the groove portions is one of a rectangular shape, a U shape, or a V shape.

3. The heater according to claim 1, wherein the groove portions have different depths from each other.

4. The heater according to claim 3, wherein the depths of the groove portions nearer an end portion of the heat generating unit are shallower than depths of the groove portions in a central portion of the heat generating unit.

5. The heater according to claim 1, wherein a total number of groove portions in the plurality of groove portions is an even number.

6. The heater according to claim 5, wherein a shape of the groove portions is one of a rectangular shape, a U shape, or a V shape.

7. A fixing device comprising:

a rotary body;

a heat generating unit adjacent to an inside surface of the rotary body at a position where heat is transmitted from the rotary body to a medium contacting an outside surface of the rotary body the heat generating unit having a first side facing a second side; and a plurality of electrodes disposed on the first and second sides of the heat generating unit, a plurality of groove portions extending partially through the heat generating unit on at least the first side, each groove portion being at position respectively corresponding to a space between an adjacent pair of electrodes in the plurality of electrodes.

8. The device according to claim 7, wherein a common electrode is on the second side and a distance between at least two groove portions on the first side corresponds to a predetermined passage region of the medium.

9. The device according to claim 8, wherein a total number of groove portions in the plurality of groove portions is an even number.

10. The device according to claim 9, wherein a shape of the groove portions is one of a rectangular shape, a U shape, and a V shape.

* * * * *